US008747078B2

(12) United States Patent
Brown et al.

(10) Patent No.: US 8,747,078 B2
(45) Date of Patent: Jun. 10, 2014

(54) GAS SEPARATOR WITH IMPROVED FLOW PATH EFFICIENCY

(75) Inventors: Donn J. Brown, Broken Arrow, OK (US); Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 361 days.

(21) Appl. No.: 13/205,217

(22) Filed: Aug. 8, 2011

(65) Prior Publication Data

US 2013/0039782 A1 Feb. 14, 2013

(51) Int. Cl.
*F04B 39/00* (2006.01)
*B01D 45/12* (2006.01)
*E21B 43/00* (2006.01)

(52) U.S. Cl.
USPC ..... 417/313; 55/345; 166/195.5

(58) Field of Classification Search
USPC ..... 417/313; 55/345; 166/105.5, 106; 96/208, 211, 212, 216
See application file for complete search history.

(56) References Cited

U.S. PATENT DOCUMENTS 4,088,459 A 5/1978 Tuzson
4,481,020 A 11/1984 Lee et al.
5,207,810 A * 5/1993 Sheth ..... 55/406
5,482,117 A 1/1996 Kolpak et al.
6,113,675 A * 9/2000 Branstetter ..... 95/261
6,289,614 B1 * 9/2001 Roselle et al. ..... 37/417
6,723,158 B2 * 4/2004 Brown et al. ..... 96/214
7,461,692 B1 12/2008 Wang
2003/0111230 A1 * 6/2003 Olson et al. ..... 166/369

FOREIGN PATENT DOCUMENTS

WO 2009097869 8/2009

* cited by examiner

*Primary Examiner* — Charles Freay
(74) *Attorney, Agent, or Firm* — Bracewell & Giuliani LLP

(57) ABSTRACT

A gas separator having an improved flowpath for lighter fluids having a higher concentration of gas decreases total pumping head for an ESP assembly. The ESP assembly includes a rotary primary pump, a motor coupled to the primary pump for driving the pump, a seal assembly between the primary pump and the motor, and a gas separator between the seal assembly and the primary pump. An outlet of the gas separator feeds an intake of the primary pump, and a rotating shaft operationally couples the primary pump to the motor and passes through the seal assembly and the gas separator. The gas separator contains a venting portion, and a diverter positioned within the venting portion having diverter guide vanes formed in a flowpath of the lighter fluid for aiding in a directional change of fluid momentum. A slinger is positioned within the diverter for impelling fluid through the venting port.

18 Claims, 6 Drawing Sheets

GAS SEPARATOR WITH IMPROVED FLOW PATH EFFICIENCY

BACKGROUND OF THE INVENTION

1. Field of the Invention

This invention relates in general to electric submersible pumps (ESPs) and, in particular, to a gas separator with improved flow path efficiency.

2. Brief Description of Related Art

Electric submersible pump (ESP) assemblies are disposed within wellbores and operate immersed in wellbore fluids. The ESP assemblies generally include a pump portion and a motor portion. Generally, the motor portion is downhole from the pump portion, and a rotatable shaft connects the motor and the pump. The rotatable shaft may be one or more shafts operationally coupled together. The motor rotates the shaft that, in turn, rotates components within the pump to lift fluid through a production tubing string to the surface. The ESP assembly may also include one or more seal sections coupled to the shaft between the motor and pump. In some embodiments, the seal section connects the motor shaft to the pump intake shaft. The seal section provides an area for the expansion of the ESP motor oil volume, equalizes the internal unit pressure with the wellbore annulus pressures, isolates the clean motor oil from wellbore fluids to prevent contamination, and supports the pump shaft thrust load.

In some embodiments, the ESP assembly includes a gas separator positioned between the seal section and the pump section. ESPs are designed to handle liquid and will suffer from head degradation and gas locking in the presence of a high percentage of free gas. The gas separator is installed at the intake of the pump section, between the seal section and the pump section. Wellbore fluid enters the gas separator and passes through the gas separator into the pump intake. The wellbore fluid is rotated within the separator, centrifugally separating heavier wellbore fluid from lighter wellbore fluid. Generally, heavier wellbore fluid corresponds with fluid that has a lower gas content, and lighter wellbore fluid corresponds with fluid having a higher gas content. The gas separator then directs the heavier wellbore fluid to the pump section intake and the lighter wellbore fluid back into the annulus of the casing. The flowpath of the lighter fluid generally must make a sharp right-angle turn to exit the gas separator and flow back into the casing annulus. The sharp right angle turn causes an increase in the fluid pressure where the lighter wellbore fluid must make a rapid change in momentum to exit, the separator. This coincides with a change in momentum from a path moving circularly uphole and radially inward to a path moving normal to the previous circular path. This pressure increase causes a notable increase in the amount of pumping head needed within the separator chamber. Thus, there is a need for a gas separator within an improved fluid flowpath to increase the efficiency of the overall ESP assembly.

SUMMARY OF THE INVENTION

These and other problems are generally solved or circumvented, and technical advantages are generally achieved, by preferred embodiments of the present invention that provide an ESP gas flow separator with improved flowpath efficiency.

In accordance with an embodiment of the present invention, a submersible pump assembly is disclosed. The pump assembly includes a rotary primary pump, a motor operationally coupled to the primary pump for driving the pump, a seal assembly between the primary pump and the motor for sealing the motor from the wellbore, and a gas separator between the seal assembly and the primary pump for separating fluid with high gas content from fluid with low gas content. An outlet of the gas separator feeds an intake of the primary pump. A rotating shaft operationally couples the primary pump to the motor, wherein the rotating shaft passes through the seal assembly and the gas separator. The gas separator contains a venting portion for passing gas from the gas separator into a wellbore. A diverter positioned within the venting portion of the gas separator directs heavier fluid into the intake of the primary pump and lighter fluid toward a venting port of the venting portion. Diverter guide vanes are formed in a flowpath of the lighter fluid for aiding in a directional change of momentum.

In accordance with another embodiment of the present invention, a submersible pump assembly is disclosed. The pump assembly includes a rotary primary pump, a motor operationally coupled to the primary pump for driving the pump, a seal assembly between the primary pump and the motor for sealing the motor from wellbore fluid, and a gas separator between the seal assembly and the primary pump for separating wellbore fluid having a higher concentration of gas from wellbore fluid having a lower concentration of gas. An outlet of the gas separator feeds an intake of the primary pump. A rotating shaft operationally couples the primary pump to the motor. The rotating shaft passes through the seal assembly and the gas separator. The gas separator contains a venting portion for passing gas from the gas separator into a wellbore. A diverter is positioned within the venting portion of the gas separator for directing heavier fluid into the intake of the primary pump and lighter fluid toward a venting port of the venting portion. Diverter guide vanes are formed in a flowpath of the lighter fluid for aiding in a directional change of momentum. The diverter is a conical member having an upstream end and a downstream end, wherein the downstream end has an inner diameter substantially equivalent to the outer diameter of the rotating shaft, and the upstream end has an inner diameter that is wider than the diameter of the rotating shaft to define a fluid passageway directing fluid toward the downstream end. The conical member defines fluid openings near the downstream end so that fluid entering the fluid passageway at the upstream end may flow into the fluid openings. The diverter guide vanes are formed within the conical member on trailing edges of the fluid openings and extend partially into the fluid passageway so that the diverter guide vanes may direct fluid into the fluid openings. The diverter guide vanes have a thickness that decreases in a direction from the trailing edge of one of the fluid openings toward an adjacent one of the fluid openings, and each guide vane has a curved inner surface. The gas separator includes a gas separator intake for intaking wellbore fluid from an area proximate to an upstream end of the gas separator, an impeller operationally coupled to the gas separator intake downstream of the gas separator intake so that the impeller may impart rotational inertia to the wellbore fluid entering through the separator intake, and a separation chamber operationally coupled to the impeller so that rotating wellbore fluid may pass from the impeller into the separation chamber. The separation chamber is operationally coupled to the venting portion.

In accordance with yet another embodiment of the present invention, a submersible pump assembly is disclosed. The pump assembly includes a rotary primary pump, a motor operationally coupled to the primary pump for driving the pump, a seal assembly between the primary pump and the motor for sealing the motor from wellbore fluid, and a gas separator between the seal assembly and the primary pump for separating wellbore fluid having a higher gas content from wellbore fluid having a lower gas content. An outlet of the gas separator feeds an intake of the primary pump. A rotating shaft operationally couples the primary pump to the motor, wherein the rotating shaft passes through the seal assembly and the gas separator. The gas separator contains a venting portion for passing gas from the gas separator into a wellbore, a diverter positioned within the venting portion of the gas separator for directing heavier fluid into the intake of the primary pump and lighter fluid toward a venting port of the venting portion, and a slinger positioned within the diverter for impelling fluid through a venting port of the venting portion. Three blades are formed on the slinger, each blade having a blade at least two portions that aid in the movement of wellbore fluid having a higher gas content from the gas separator. The gas separator also includes gas separator intake for intaking wellbore fluid from an area proximate to an upstream end of the gas separator, an impeller operationally coupled to the gas separator intake downstream of the gas separator intake so that the impeller may impart rotational inertia to the wellbore fluid entering through the separator intake, and a separation chamber operationally coupled to the impeller so that rotating wellbore fluid may pass from the impeller into the separation chamber. The separation chamber is operationally coupled to the venting portion.

An advantage of the disclosed embodiments is that they provide a gas separator with improved flowpath efficiency. As a result, the total pumping head required to lift fluid to the surface is reduced. Additional embodiments include a slinger with modified blades that increase the flow rate of high gas content fluid out of the gas separator and into the wellbore, further increasing efficiency.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning ESP operation, construction, and the like have been omitted inasmuch as such details are not considered necessary to obtain a complete understanding of the present invention, and are considered to be within the skills of persons skilled in the relevant art.

Figure 1:
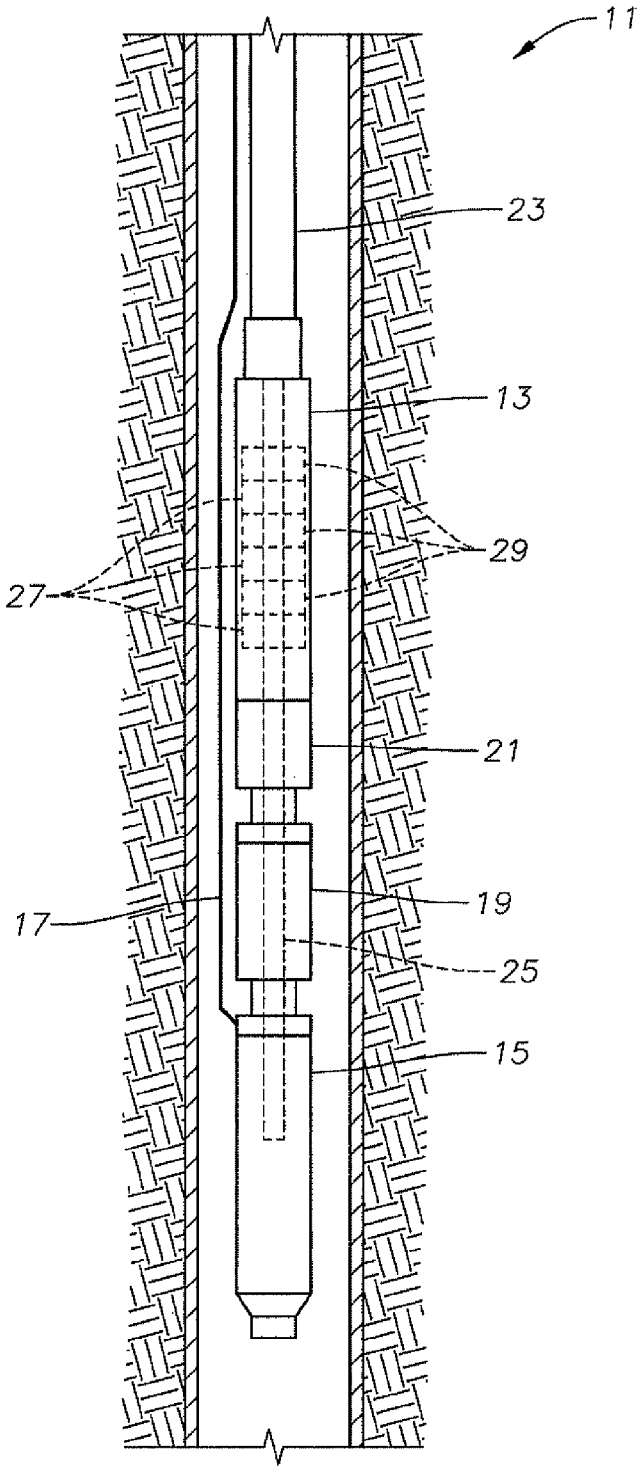
FIG. 1 is a schematic representation of an ESP assembly disposed within a cased wellbore.

The exemplary embodiments of the downhole assembly of the present invention are used in oil and gas wells for producing large volumes of well fluid. As illustrated in FIG. 1, a downhole assembly 11 has an electric submersible pump 13 ("ESP") with a large number of stages of impellers 25 and diffusers 27. ESP 13 is driven by a downhole motor 15, which is a large three-phase AC motor. Motor 15 receives power from a power source (not shown) via power cable 17. Motor 15 is filled with a dielectric lubricant. A seal section 19 separates motor 15 from ESP 13 for equalizing internal pressure of lubricant within the motor to that of the well bore. A gas separator 21 for at least partially removing gas from the well fluid is installed on a pump intake portion of ESP 13. Additional components may be included, such as a sand separator, and a pressure and temperature measuring module. Large ESP assemblies may exceed 100 feet in length. An upper end of ESP 13 couples to a production string 23.

A rotating shaft 25 may extend from motor 15 up through seal section 19, gas separator 21, and ESP 13. Motor 15 may rotate shaft 25 to, in turn, rotate impellers 27 within ESP 13. A person skilled in the art will understand that shaft 25 may comprise multiple shafts configured to rotate in response to rotation of the adjacent upstream coupled shaft. Impellers 27 will generally operate to lift fluid within ESP 13 and move the fluid up production string 23. Impellers 27 perform this function by drawing fluid into a center of each impeller 27 near shaft 25 and accelerating the fluid radially outward. Generally, the fluid accelerated by each impeller 27 will then flow into a diffuser 29 axially above impeller 27. There, the fluid is directed from a radially outward position to a radially inward position adjacent shaft 25 where the fluid is drawn into a center of the next impeller 27.

Figure 2:
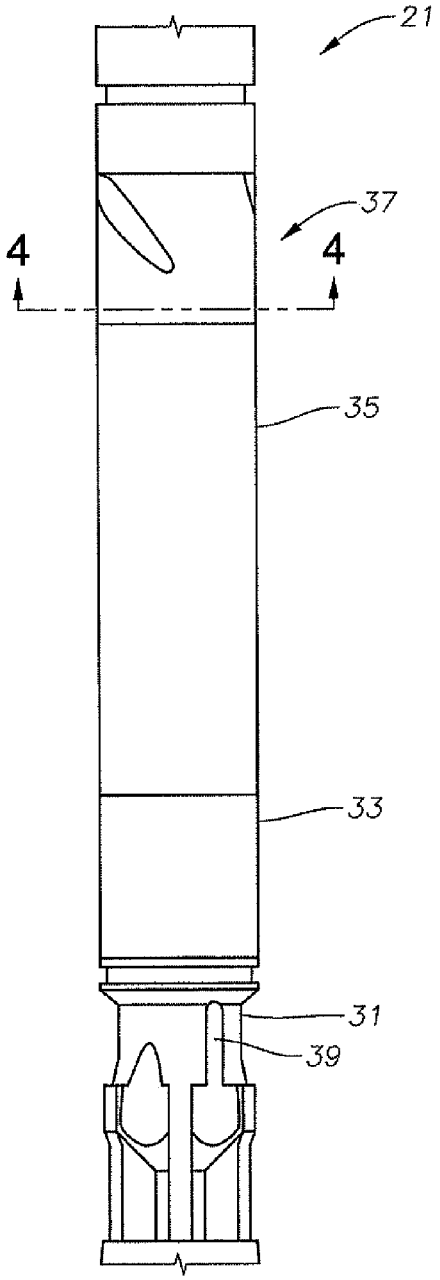
FIG. 2 is a schematic representation of a gas separator in accordance with an embodiment of the invention.
Figure 3:
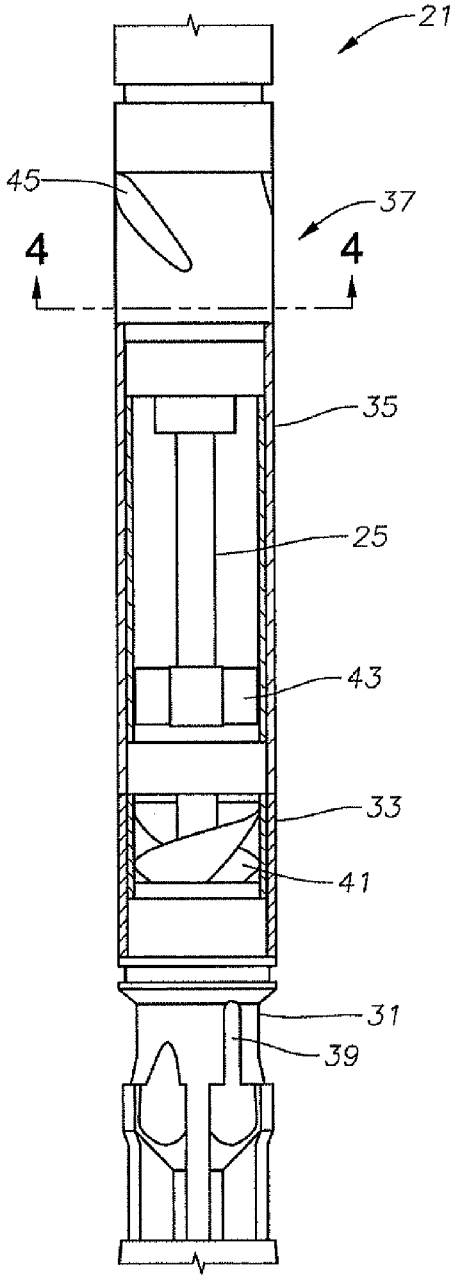
FIG. 3 is a schematic representation of a gas separator wherein a portion of the exterior housing of the gas separator has been removed for an internal view of the gas separator.

Referring now to FIG. 2, there is shown gas separator 21. In the illustrated embodiment, gas separator 21 includes an intake portion 31, a flow inducer portion 33, a separation chamber 35, and a venting portion 37. Intake portion 31 includes an intake 39 that allows flow of wellbore fluid from the area around the gas separator 21 into an interior cavity of gas separator 21. The intake directs fluid toward flow inducer portion 33. As shown in FIG. 3, flow inducer portion 33 includes an inducer or flow inducer 41. Flow inducer 41 imparts rotational energy to the wellbore fluid causing the wellbore fluid to rotate around shaft 25 as it flows into separation chamber 35. In an embodiment, separation chamber 35 includes lower guide vanes 43 at an upstream end of gas separator 21 proximate to flow inducer 41. Lower guide vanes 43 rotationally direct the wellbore fluid as it passes into separation chamber 35 from Flow inducer portion 33 to increase rotational flow of the fluid. As fluid moves downstream in separation chamber 35, the rotational momentum imparted to the wellbore fluid by flow inducer 41 and guide vanes 43 centrifugally separates heavier wellbore fluid having a lower gas concentration from lighter wellbore fluid having a higher concentration of gas. The heavier wellbore fluid will then flow downstream along the outer diameter portions of separation chamber 35 and the lighter wellbore fluid will flow downstream along rotating shaft 25. Heavier wellbore fluid will flow through venting portion 37 and into an intake of ESP 13, while lighter wellbore fluid will flow into venting portion 37 and be directed back into the area around ESP 13 through venting ports 45, as described in more detail below.

Figure 4:
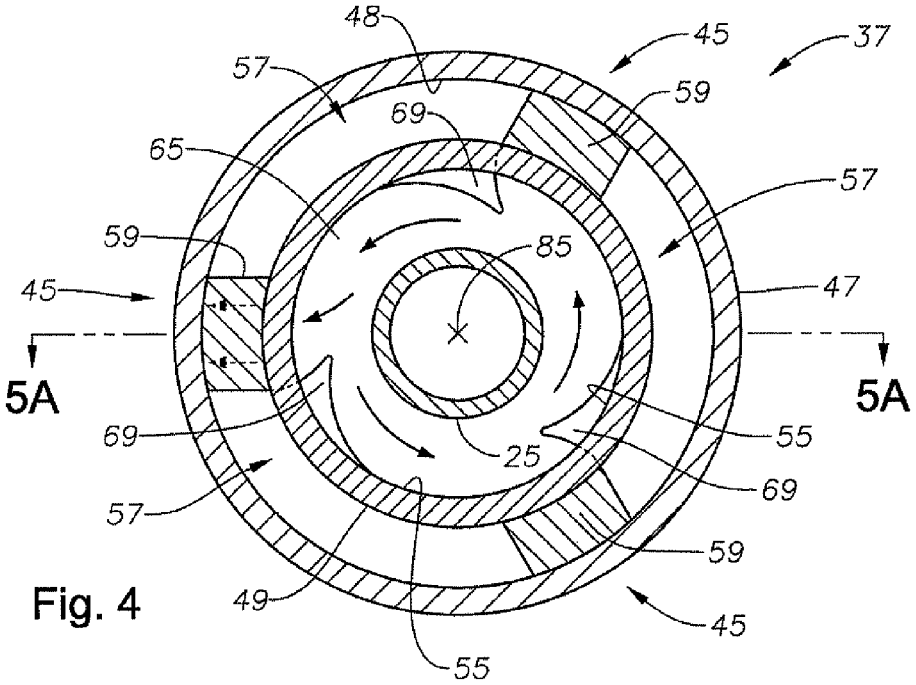
FIG. 4 is a sectional view of a venting portion of the gas separator taken along line 4A-4A of FIG. 2 and FIG. 3.

Referring to FIG. 4, a sectional view of venting portion 37 is shown looking downstream into venting portion 37 from the upstream end of venting portion 37. As shown, wellbore fluid flows in a counterclockwise manner when looking downstream through venting portion 37. Venting portion 37 includes a tubular wall 47 defining a central passage 48 and an axis 85. Rotating shaft 25 is positioned within and concentric with tubular wall 47. Venting portion 37 includes a crossover or diverter 49. Diverter 49 is a generally conical member having an inner diameter at the downstream end 51 (FIG. 5A) that is approximately equal to the outer diameter of rotating shaft 25. Diverter 49 has an upstream end 53 (FIG. 5A) that is concentric with rotating shaft 25 and has an inner diameter 55 that is wider than the diameter of diverter 49 at downstream end 51. Upstream end 53 defines an annulus 57 between the inner diameter of tubular wall 47 and the outer diameter of diverter 49. As shown in FIG. 4, annulus 57 may be divided into three portions by lower members 59 of diverter 49. In the illustrated embodiment, there are three lower members 59 extending between the outer diameter of diverter 49 and the inner diameter of tubular wall 47 a portion of the circumferential distance around the outer diameter of upstream end 53 as shown. In this manner, members 59 create a lower portion of a venting chamber 61 (FIG. 5A) having an inlet through diverter 49 and an outlet at venting ports 45.

Figure 5B:
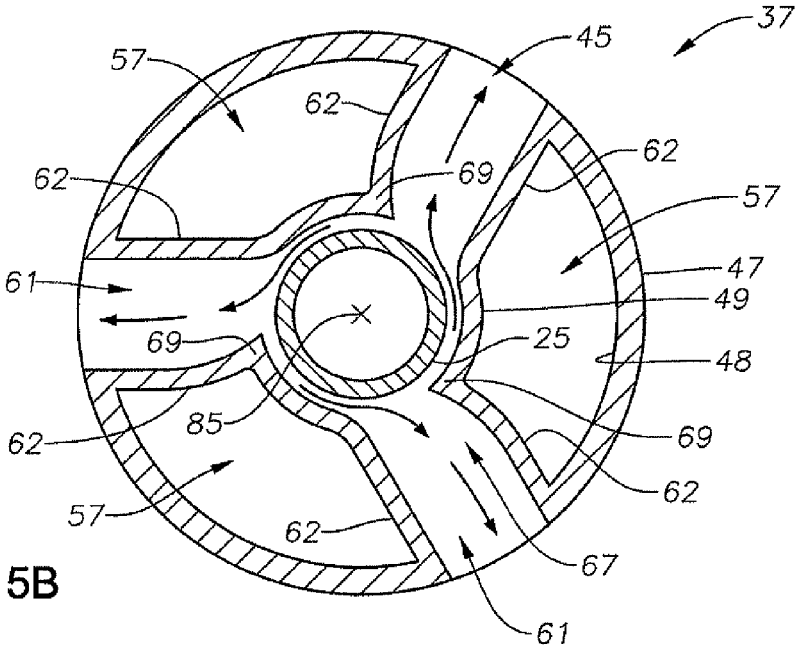
FIG. 5B is a sectional view of the venting portion of the gas separator taken along line 5B-5B of FIG. 5A.
Figure 5A:
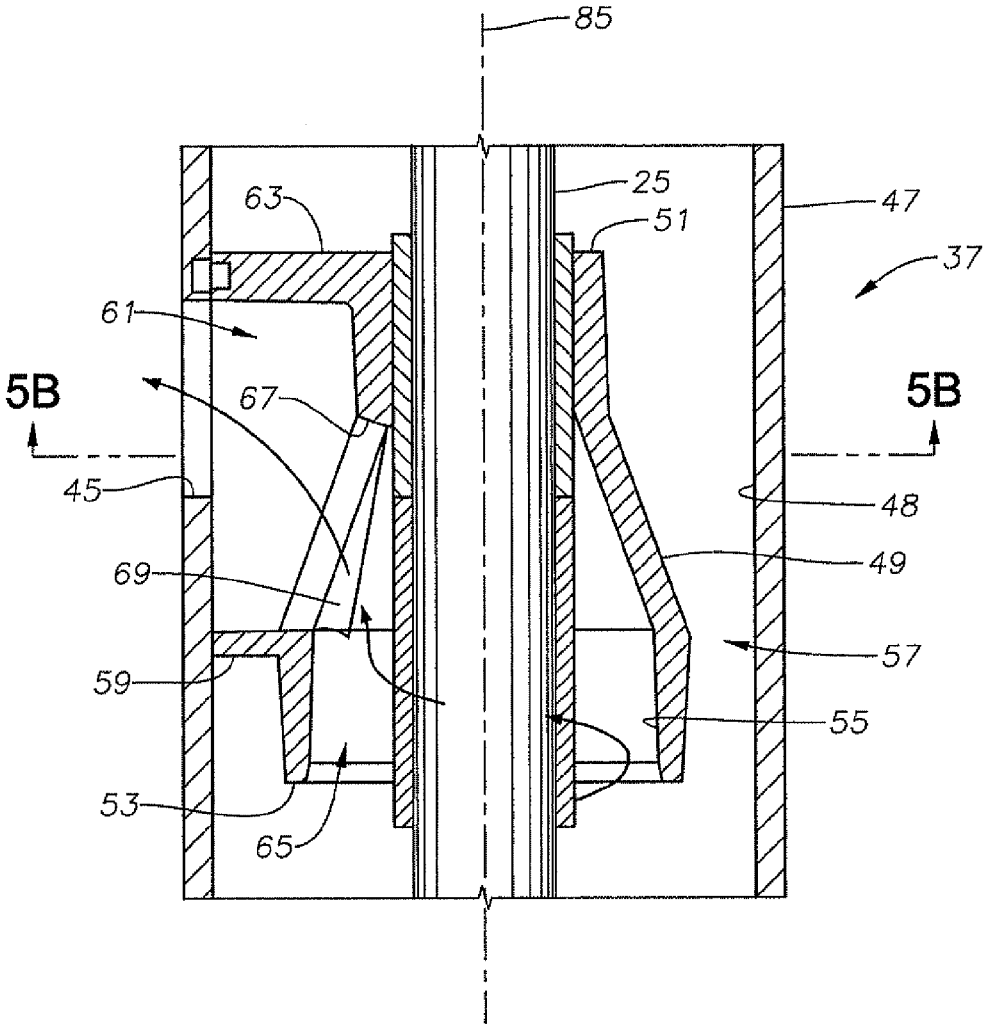
FIG. 5A is a sectional view of the venting portion of the gas separator taken along line 5-5 of FIG. 4.

As shown in FIG. 5A, diverter 49 also includes upper members 63 extending from downstream end 51 to secure to tubular wall 47 at venting port 45 directly over lower members 59. Venting chamber 61 includes sidewalls 62 (FIG. 5B) extending from lower members 59 to upper members 63 so that fluid in annulus 57 may not communicate with fluid in venting chamber 61 or pass from annulus 57 through venting port 45. In the illustrated embodiment, there are three upper members 63, one of which is shown in FIG. 5A, resulting in three venting ports 45.

Upstream end 53 also defines a fluid passageway 65 between inner diameter 55 of upstream end 53 and the outer diameter of rotating shaft 25. Diverter 49 defines an opening 67 (FIG. 5A) through a wall of diverter 49 so that fluid may move from fluid passageway 65 into venting chamber 61 as fluid moves downstream within diverter 49. Opening 67 is proximate to downstream end 51 where the inner diameter of diverter 49 narrows to the outer diameter of rotating shaft 25 and extends upstream to lower member 59. As shown in FIG. 4 and FIG. 5A, diverter guide vanes 69 are formed at each opening 67. Diverter guide vanes 69 extend partially into fluid passageway 65 and have a leading edge that tapers with the angle of the sidewall of diverter 49 between upstream end 53 and downstream end 51. Guide vanes 69 have a modified airfoil shape as shown and are located at the trailing edge of each opening 67.

As shown in FIG. 4, FIG. 5A, and FIG. 58, centrifugally separated heavier wellbore fluid flowing along tubular wall 47 will flow through annulus 57 around diverter 49. Lighter wellbore fluid having a higher gas concentration will flow along rotating shaft 25 and into fluid passageway 65. As fluid passageway 65 narrows (FIG. 5B) moving from upstream end 53 toward downstream end 51, lighter wellbore fluid will be directed into venting chamber 61 by diverter guide vanes 69. The modified airfoil shape of diverter guide vanes 69 aids in changing the upward and inward momentum of the lighter wellbore fluid. This results in a fluid flowpath that changes direction from along rotating shaft 25 into venting chamber 61 and out venting port 45 with greater velocity and reduced head.

Figure 6:
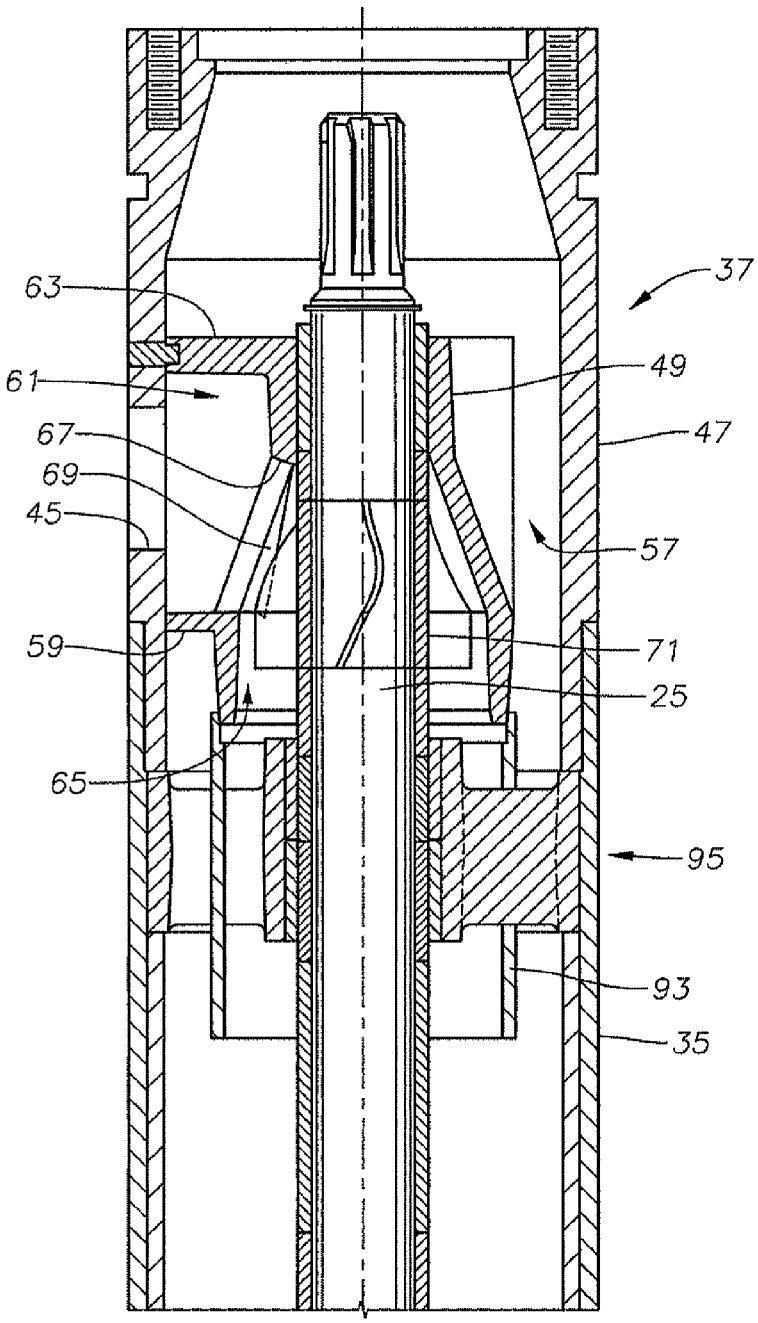
FIG. 6 is a sectional view of the venting portion of the gas separator taken along line 5-5 of FIG. 4 illustrating an alternative embodiment of the present invention.
Figure 8:
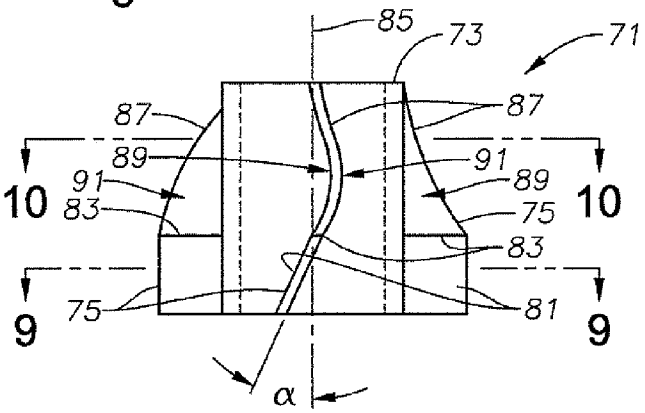
FIGS. 7 and 8 are front and top views of a slinger of FIG. 6 in accordance with an embodiment of the present invention.
Figure 7:
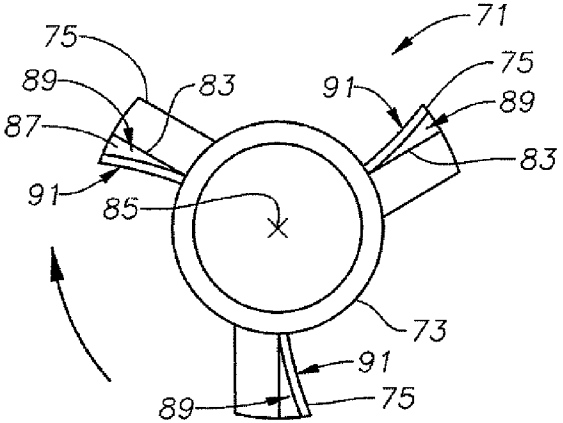
Figure 9:
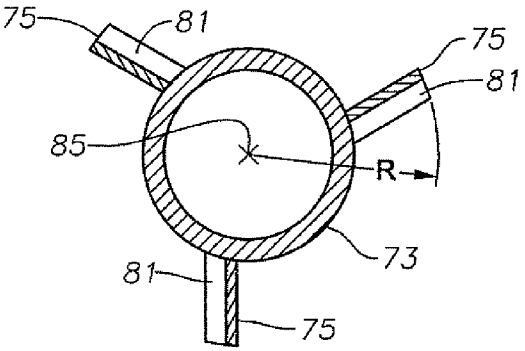
FIG. 9 is a sectional view of the slinger of FIGS. 7 and 8 taken along line 9-9 of FIG. 8.

Referring to FIG. 6, in an alternative embodiment, venting portion 37 may also include a slinger 71. Slinger 71 may be secured to rotating shaft 25 within diverter 49 so that slinger 71 may rotate within diverter 49 in response to rotation of rotating shaft 25. As shown in FIGS. 7 and 8, slinger 71 comprises a cylindrical body 73 having at least one blade 75 formed on an outer diameter portion of cylindrical body 73. In the illustrated embodiment, the direction of rotation of slinger 71 indicated by the arrow in FIG. 7. Each blade 75 has an upstream portion 81 with a first geometric configuration, in this case a substantially square shape, that extends downstream along a portion of cylindrical body 73 to a junction 83. Upstream portion 81 forms an angle $\alpha$ with axis 85 passing through a center of cylindrical body 73. As shown in FIG. 9, upstream portion 81 has an outer radius R from axis 85 that is constant from an upstream terminal end of upstream portion 81 to junction 83.

Figure 10:
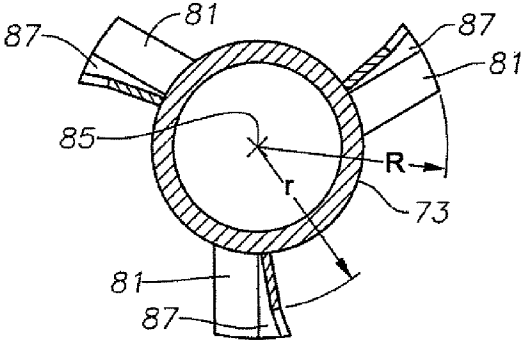
FIG. 10 is a sectional view of the slinger of FIGS. 7 and 8 taken along line 10-10 of FIG. 8.

Each blade 75 has a downstream portion 87 from junction 83 to the downstream end of cylindrical body 73. As shown in FIG. 10, a radius r of downstream portion 87 from axis 85 decreases in width from junction 83 to the downstream end of cylindrical body 73 so that downstream portion 87 tapers to the outer diameter of cylindrical body 73 at the downstream end of cylindrical body 73 from a radius R of upstream portion 81 at junction 83. Downstream portion 87 of each fin 75 has a leading surface 89 and a trailing surface 91. As shown in FIG. 8, leading surface 89 is concave and trailing surface 91 is convex. Preferably, the curvature of downstream portion 87 from junction 83 to the downstream end of cylindrical body 73 is such that there is a relatively smooth fluid flowpath from upstream portion 81 across junction 83 and downstream portion 87. In this manner, turbulent flow along blade 75 may be reduced as fluid accelerates out of venting portion 37.

In the embodiment of FIG. 6, slinger 71 rotates as indicated by the arrow. A tubular wall 93 may be secured to upstream end 53 of diverter 49 extending annulus 57 to the upstream end of tubular wall 93. Tubular wall 93 will maintain separation of heavier and lighter wellbore fluids as the fluids move past a bearing 95 supporting rotating shaft 25 within separation chamber 35. In addition, tubular wall 93 will limit inflow of heavier wellbore fluid into diverter 49 during rotation of slinger 71. Heavier wellbore fluid will flow through annulus 57, past diverter 49, and into an intake of ESP 13 (FIG. 1). Lighter wellbore fluid having a higher gas concentration will flow into fluid pathway 65 through a central bore of tubular wall 93. There, slinger 71 imparts additional rotational energy to the lighter wellbore fluid increasing the flowrate of the lighter wellbore fluid through opening 67. When used with diverter guide vanes 69 as shown in FIG. 6, the increased flowrate and reduction in head loss at opening 67 caused by diverter guide vanes 69 greatly improves the efficiency of gas separator 21. A person skilled in the art will understand that slinger 71 may be used with a diverter 49 without diverter guide vanes 69. Similarly, a person skilled in the art will understand that diverter 49 having diverter guide vanes 69 may be used without slinger 69 as shown in FIG. 4 and FIG. 5A.

Accordingly, the disclosed embodiments provide numerous advantages. For example, the disclosed embodiments provide a gas separator having a higher flowrate efficiency. The disclosed embodiments accomplish this by providing guide vanes within the diverter that reduce flow resistance and turbulence by aiding the change in direction of fluid momentum from along the rotating shaft toward an exterior of the gas separator. In addition, the disclosed embodiments provide a slinger that further impels the fluid, increasing the flowrate of separated gas fluid through the venting ports of the gas separator.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A submersible pump assembly comprising:

a rotary primary pump;

a motor operationally coupled to the primary pump for driving the pump;

a seal assembly between the primary pump and the motor for sealing the motor from the wellbore;

a gas separator between the seal assembly and the primary pump for separating fluid with higher gas content from fluid with lower gas content, wherein an outlet of the gas separator feeds an intake of the primary pump;

a rotating shaft operationally coupling the primary pump to the motor, wherein the rotating shaft passes through the seal assembly and the gas separator;

wherein the gas separator contains a venting portion for passing gas from the gas separator into a wellbore;

a diverter positioned within the venting portion of the gas separator for directing heavier fluid into the intake of the primary pump and lighter fluid toward a venting port of the venting portion;

diverter guide vanes formed within the diverter in a flowpath of the lighter fluid for aiding in a directional change of momentum;

a conical member having an upstream end and a downstream end, wherein the downstream end has an inner diameter substantially equivalent to the outer diameter of the rotating shaft, and the upstream end has an inner diameter that is wider than the diameter of the rotating shaft to define a fluid passageway directing fluid toward the downstream end;

wherein the conical member defines fluid openings near the downstream end so that fluid entering the fluid passageway at the upstream end may flow into the fluid openings; and wherein the diverter guide vanes are formed within the conical member on trailing edges of the fluid openings and extend partially into the fluid passageway so that the diverter guide vanes may direct fluid into the fluid openings.

2. The submersible pump assembly of claim 1, wherein the diverter guide vanes have a thickness that decreases in a direction from the trailing edge of one of the fluid openings toward an adjacent one of the fluid openings.

3. The submersible pump assembly of claim 1, wherein the diverter guide vanes have a thickness that decreases in a downstream direction.

4. The submersible pump assembly of claim 1, wherein an upstream end of each guide vane is located adjacent an upstream end of each of the fluid openings.

5. The submersible pump assembly of claim 1, wherein each guide vane has a curved inner surface.

6. The submersible pump assembly of claim 1 further comprising a slinger positioned within the diverter inward from the diverter guide vanes and rotated by the rotating shaft for impelling fluid through the venting port.

7. The submersible pump assembly of claim 6, wherein the slinger further comprises a plurality of blades.

8. The submersible pump assembly of claim 7, wherein each of the blades has an upstream portion extending downstream from an upstream end of the blade to a junction and a downstream and different portion from the junction to the downstream end of the blade, each portion having leading and trailing surfaces curving into the direction of rotation.

9. The submersible pump assembly of claim 7, wherein:

the upstream portion is substantially rectangular; and the upstream portion forms an angle with an axis of the tubular member so that an upstream end of the upstream portion is positioned forward of a downstream end of the upstream portion when the tubular member rotates.

10. The submersible pump assembly of claim 7, wherein:

the downstream portion has a wider radius from an axis of the tubular member at the junction and a narrower radius at a downstream end of the downstream portion, wherein the wider radius is substantially equivalent to a radius of the upstream portion;

the leading surface of the downstream portion is concave; and the trailing surface of the downstream portion is convex.

11. A submersible pump assembly comprising:

a rotary primary pump;

a motor operationally coupled to the primary pump for driving the pump;

a seal assembly between the primary pump and the motor for sealing the motor from wellbore fluid;

a gas separator between the seal assembly and the primary pump for separating wellbore fluid having a higher concentration of gas from wellbore fluid having a lower concentration of gas, wherein an outlet of the gas separator feeds an intake of the primary pump;

a rotating shaft operationally coupling the primary pump to the motor, wherein the rotating shaft passes through the seal assembly and the gas separator;

wherein the gas separator contains a venting portion for passing gas from the gas separator into a wellbore;

a diverter positioned within the venting portion of the gas separator for directing heavier fluid into the intake of the primary pump and lighter fluid toward a venting port of the venting portion;

diverter guide vanes formed in a flowpath of the lighter fluid for aiding in a directional change of momentum;

wherein the diverter is a conical member having an upstream end and a downstream end, wherein the downstream end has an inner diameter substantially equivalent to the outer diameter of the rotating shaft, and the upstream end has an inner diameter that is wider than the diameter of the rotating shaft to define a fluid passageway directing fluid toward the downstream end;

wherein the conical member defines fluid openings near the downstream end so that fluid entering the fluid passageway at the upstream end may flow into the fluid openings;

wherein the diverter guide vanes are formed within the conical member on trailing edges of the fluid openings and extend partially into the fluid passageway so that the diverter guide vanes may direct fluid into the fluid openings;

wherein the diverter guide vanes have a thickness that decreases in a direction from the trailing edge of one of the fluid openings toward an adjacent one of the fluid openings;

wherein each guide vane has a curved inner surface;

a gas separator intake for intaking wellbore fluid from an area proximate to an upstream end of the gas separator;

an impeller operationally coupled to the gas separator intake downstream of the gas separator intake so that the impeller may impart rotational inertia to the wellbore fluid entering through the separator intake;

a separation chamber operationally coupled to the impeller so that rotating wellbore fluid may pass from the impeller into the separation chamber; and wherein the separation chamber is operationally coupled to the venting portion.

12. The submersible pump assembly of claim 11, wherein the diverter guide vanes have a thickness that decreases in a downstream direction.

13. The submersible pump assembly of claim 11, wherein an upstream end of each guide vane is located adjacent an upstream end of each of the fluid openings.

14. The submersible pump assembly of claim 11 further comprising:

a slinger positioned within the diverter inward from the diverter guide vanes and rotated by the rotating shaft for impelling fluid through the venting port; and wherein the slinger has a plurality of blades.

15. A submersible pump assembly comprising:

a rotary primary pump;

a motor operationally coupled to the primary pump for driving the pump;

a seal assembly between the primary pump and the motor for sealing the motor from wellbore fluid;

a gas separator between the seal assembly and the primary pump for separating wellbore fluid having a higher gas content from wellbore fluid having a lower gas content, wherein an outlet of the gas separator feeds an intake of the primary pump;

a rotating shaft operationally coupling the primary pump to the motor, wherein the rotating shaft passes through the seal assembly and the gas separator;

wherein the gas separator contains a venting portion for passing gas from the gas separator into a wellbore;

a diverter positioned within the venting portion of the gas separator for directing heavier fluid into the intake of the primary pump and lighter fluid toward a venting port of the venting portion;

a slinger positioned within the diverter for impelling fluid through a venting port of the venting portion;

wherein three blades are formed on the slinger, each blade having a blade portions that aid in the movement of wellbore fluid having a higher gas content from the gas separator;

a gas separator intake for intaking wellbore fluid from an area proximate to an upstream end of the gas separator;

an impeller operationally coupled to the gas separator intake downstream of the gas separator intake so that the impeller may impart rotational inertia to the wellbore fluid entering through the separator intake;

a separation chamber operationally coupled to the impeller so that rotating wellbore fluid may pass from the impeller into the separation chamber;

wherein the separation chamber is operationally coupled to the venting portion;

wherein each of the blades has an upstream portion extending downstream from an upstream end of the blade to a junction and a downstream portion extending from the junction to the downstream end of the blade, each portion having leading and trailing surfaces curving into the direction of rotation.

16. The submersible pump assembly of claim 15, wherein the diverter further comprises diverter guide vanes formed within in a flowpath of the lighter fluid for aiding in a directional change of momentum to the venting portion.

17. The submersible pump assembly of claim 15, wherein:

the upstream portion is substantially rectangular; and the upstream portion forms an angle with an axis of the tubular member so that an upstream end of the upstream portion is positioned forward of a downstream end of the upstream portion when the tubular member rotates.

18. The submersible pump assembly of claim 15, wherein:

the downstream portion has a wider radius from an axis of the tubular member at the junction and a narrower radius at a downstream end of the downstream portion, wherein the wider radius is substantially equivalent to a radius of the upstream portion;

the leading surface of the downstream portion is concave; and the trailing surface of the downstream portion is convex.

* * * * *

UNITED STATES PATENT AND TRADEMARK OFFICE

CERTIFICATE OF CORRECTION

PATENT NO. : 8,747,078 B2
APPLICATION NO. : 13/205217
DATED : June 10, 2014
INVENTOR(S) : Donn J. Brown et al.

It is certified that error appears in the above-identified patent and that said Letters Patent is hereby corrected as shown below:

In the Specification
Column 3, line 16, insert -- a -- between "includes" and "gas"
Column 5, line 8, delete "Flow" and insert -- flow --
Column 6, line 44, delete "fin" and insert -- blade --

In the Claims
Claim 15, Column 10, line 17, delete "portions" and insert -- portion --
Claim 15, Column 10, line 17, delete "aid" and insert -- aids --

Signed and Sealed this
Sixth Day of January, 2015

Michelle K. Lee

Michelle K. Lee
*Deputy Director of the United States Patent and Trademark Office*